US008246361B2

(12) United States Patent
Dennes et al.

(10) Patent No.: US 8,246,361 B2
(45) Date of Patent: Aug. 21, 2012

(54) ELECTRICAL CONNECTOR

(75) Inventors: Wayne William Dennes, Wyoming (AU); Jeffrey Allan Glen, Birchgrove (AU)

(73) Assignee: ADC GmbH, Berlin (DE)

( * ) Notice: Subject to any disclaimer, the term of this patent is extended or adjusted under 35 U.S.C. 154(b) by 0 days.

(21) Appl. No.: 12/300,201

(22) PCT Filed: Apr. 16, 2007

(86) PCT No.: PCT/EP2007/003320

§ 371 (c)(1), (2), (4) Date: Mar. 20, 2009

(87) PCT Pub. No.: WO2007/128380

PCT Pub. Date: Nov. 15, 2007

(65) Prior Publication Data

US 2009/0258533 A1 Oct. 15, 2009

(30) Foreign Application Priority Data

May 9, 2006 (AU) ..... 2006902434

(51) Int. Cl.
*H01R 13/648* (2006.01)

(52) U.S. Cl. ..... 439/107; 439/402; 439/658

(58) Field of Classification Search ..... 200/289, 200/269; 439/395, 402–410, 535, 107, 658; 307/31–38

See application file for complete search history.

(56) References Cited

U.S. PATENT DOCUMENTS

D91,940 S 4/1934 Hollingsworth
2,685,651 A * 8/1954 Collins ..... 290/28

(Continued)

FOREIGN PATENT DOCUMENTS

AU 629900 10/1995

(Continued)

OTHER PUBLICATIONS

Co-pending and commonly owned U.S. Appl. No. 29/297,084, filed Nov. 2, 2007, by Dennes et al.

*Primary Examiner* — R S Luebke
*Assistant Examiner* — Larisa Tsukerman
(74) *Attorney, Agent, or Firm* — Merchant & Gould, P.C.

(57) ABSTRACT

An electrical connector for making electrical connection to insulated conductors, the connector having a first connector part which has lengthwise extending wire channels for receiving portions of the insulated conductors; insulation displacement contacts for making separate electrical connections to the conductors, when received in the lengthwise extending wire channels, under relative movement between the insulation displacement contacts and the wires, so that the insulation covering the conductors is cut and the insulation displacement contacts make electrical connections to the conductors; transverse wire channels intersecting with said lengthwise extending wire channels and being shaped to receive portions of insulated conductors of another electrical cable from which the outer covering of the cable has been removed; and a second connector part relatively moveable with respect to the first part for effecting said relative movement, wherein the insulation displacement contacts are located at intersections of the transverse wire channels and the lengthwise extending wire channels for electrically connecting conductors seated in the transverse wire channels with respective ones of the conductors seated in the lengthwise extending wire channels during said relative movement, and said insulation displacement contacts form parts of contact elements which form socket contacts of a socket formed on the first part, said socket being adapted to receive and make electrical connection to an electrical plug.

18 Claims, 14 Drawing Sheets

U.S. PATENT DOCUMENTS

| | | | | | |
|---|---|---|---|---|---|
| 2,979,624 | A | * | 4/1961 | Askerneese | 307/38 |
| 4,333,701 | A | * | 6/1982 | Schick | 439/410 |
| 4,405,187 | A | | 9/1983 | Muller et al. | |
| 4,452,502 | A | | 6/1984 | Forberg et al. | |
| 4,500,746 | A | | 2/1985 | Meehan | |
| 4,548,459 | A | | 10/1985 | Mosser et al. | |
| 4,614,570 | A | | 9/1986 | Pliefke | |
| 4,614,576 | A | | 9/1986 | Goldstein | |
| 4,675,537 | A | * | 6/1987 | Mione | 307/38 |
| 5,100,332 | A | | 3/1992 | Egawa | |
| 5,424,903 | A | * | 6/1995 | Schreiber | 361/166 |
| 5,435,747 | A | * | 7/1995 | Franckx et al. | 439/409 |
| 5,492,484 | A | | 2/1996 | Archer | |
| 5,579,201 | A | * | 11/1996 | Karageozian | 361/119 |
| 5,708,554 | A | * | 1/1998 | Liner | 361/104 |
| 5,820,404 | A | * | 10/1998 | Chishima et al. | 439/417 |
| 6,095,848 | A | * | 8/2000 | Munshi | 439/417 |
| 6,142,815 | A | * | 11/2000 | Whiteman et al. | 439/381 |
| 6,211,581 | B1 | * | 4/2001 | Farrant | 307/117 |
| 6,299,472 | B1 | * | 10/2001 | Beukes | 439/403 |
| D454,543 | S | | 3/2002 | Hu | |
| 6,406,323 | B2 | | 6/2002 | Shan | |
| 6,457,989 | B1 | * | 10/2002 | Aoki et al. | 439/402 |
| 6,468,102 | B1 | * | 10/2002 | Murakami et al. | 439/404 |
| 6,486,407 | B1 | * | 11/2002 | Hawker et al. | 174/149 B |
| 6,666,712 | B1 | * | 12/2003 | Kramer | 439/501 |
| 6,688,904 | B1 | * | 2/2004 | Schnalzger et al. | 439/404 |
| 7,132,763 | B2 | * | 11/2006 | Rendic | 307/31 |
| 7,186,146 | B1 | * | 3/2007 | Chang et al. | 439/650 |
| 7,435,119 | B2 | | 10/2008 | Chang et al. | |
| D587,203 | S | | 2/2009 | Dennes et al. | |
| 7,585,339 | B2 | * | 9/2009 | Dahl et al. | 48/197 FM |
| 2002/0013081 | A1 | | 1/2002 | Shan | |

FOREIGN PATENT DOCUMENTS

| | | |
|---|---|---|
| AU | 778341 | 7/2001 |
| AU | 784652 | 1/2003 |
| AU | 2005203509 | 5/2006 |

* cited by examiner

ELECTRICAL CONNECTOR

This application is a National Stage Application of PCT/EP2007/003320, filed 16 Apr. 2007, which claims benefit of Serial No. PV 2006902434, filed 9 May 2006 in Australia and which application(s) are incorporated herein by reference. To the extent appropriate, a claim of priority is made to each of the above disclosed applications.

FIELD OF THE INVENTION

This invention relates to an electrical connector.

BACKGROUND OF INVENTION

Electrical connectors, useful in electrical power wiring, have previously employed screw contacts for effecting electrical connections. The connectors may be somewhat inconvenient to use, requiring the following steps to be performed:

1. Stripping of insulation from end portions of wires;
2. Inserting stripped end portions of the wires into receiving openings of the connector; and
3. Screwing down of screws of the connector in order to make the connections.

Performing the above-described steps to install an electrical connector may be labour intensive, and inconvenient.

Electrical connectors may not have previously included means for controlling their operation. It may be difficult to control the operation of the individual connectors in a plurality of such connectors coupled together in series.

Insulation displacement contacts may be formed from a contact element which is bifurcated so as to define two opposed contact portions separated by a slot into which an insulated wire may be pressed so that edges of the contact portions engage and displace the insulation and such that the contact portions resiliently engage and make electrical connection with the conductor of the wire. Such a contact is described in, for example U.S. Pat. Nos. 4,452,502 and 4,405,187.

While, in some cases, making electrical connection to a single wire in the above way is all that is necessary, occasions arise where it would be useful to make connection to more than one wire by inserting the wires, one after the other, into the slot. With a carefully designed contact it may be possible to make connections in this way to two wires, but it is difficult to make effective connections to several wires. This arises because, during the process of introducing a first wire into the slot, the contact portions are resiliently deformed, such that the gap between them is to some extent increased. The resultant increase in slot width may still permit an adequate connection to be made to a second wire when inserted into the slot. However, the increased slot width may even be such that the contact portions fail to properly pierce the insulation, or it may otherwise leave the second wire unreliably gripped. This problem becomes worse as more wires are inserted.

The above problem is alleviated in Krone LSA-PLUS connectors by arranging that the contact portions are torsionally twisted during insertion of the wires. That is, the wires are introduced into the slot with their directions of extent arranged at an angle of about 45 degrees to the side to side direction of the slot, so that insertion of the wires tends to deflect contacting edges of the respective contact portions outwardly away from each other, in opposite directions relative to the general plane of the contact. In that case, it is possible to achieve good connection to two wires but even in this construction more than two wires may not be adequately accommodated.

U.S. Pat. No. 5,492,484 also describes a particular form of contact that is indicated as being able to terminate more than a single conductor. This is however complicated in form.

It is generally desirable to overcome or ameliorate one or more of the above-described difficulties, or to at least provide a useful alternative.

SUMMARY OF INVENTION

In accordance with one aspect of the present invention, there is provided an electrical connector for making electrical connection to insulated conductors, the connector having:

(a) a first connector part which has lengthwise extending wire channels for receiving portions of the insulated conductors;

(b) insulation displacement contacts for making separate electrical connections to the conductors, when received in the lengthwise extending wire channels, under relative movement between the insulation displacement contacts and the wires, so that the insulation covering the conductors is cut and the insulation displacement contacts make electrical connections to the conductors;

(c) transverse wire channels intersecting with said lengthwise extending wire channels and being shaped to receive portions of insulated conductors of another electrical cable from which the outer covering of the cable has been removed; and (d) a second connector part relatively moveable with respect to the first part for effecting said relative movement, wherein the insulation displacement contacts are located at intersections of the transverse wire channels and the lengthwise extending wire channels for electrically connecting conductors seated in the transverse wire channels with respective ones of the conductors seated in the lengthwise extending wire channels during said relative movement, and said insulation displacement contacts form parts of contact elements which form socket contacts of a socket formed on the first part, said socket being adapted to receive and make electrical connection to an electrical plug.

Preferably, said insulation displacement contacts form parts of contact elements which form socket contacts of two sockets formed on the first part, said sockets being adapted to receive and make electrical connection to electrical plugs.

Preferably, the transverse channels intersect the lengthwise extending wire channels at an angle of substantially 90 degrees.

Preferably, the side to side direction of slots of the insulation displacement contacts is substantially 45 degrees to the direction of extent of the lengthwise extending wire channels.

In accordance with another aspect of the invention, there is provided an electrical connector, including:

(a) insulation displacement contacts for making electrical contact to conductors of electrically insulated wires by effecting relative movement between the conductors and the insulation displacement contacts;

(b) an electrical power socket including electrically conductive contact elements electrically connected to respective ones said insulation displacement contacts; and (c) a control circuit for controlling operation of the electrical power socket.

Preferably, the control circuit is adapted to electrically isolate the socket from a power source.

Preferably, the control circuit is adapted to electrically isolate the socket from a power source without effecting the operation of electric devices also electrically connected to said conductors.

Preferably, the control circuit is adapted to electrically isolate electric devices also electrically connected to said conductors without effecting the operation of the socket.

In accordance with another aspect of the invention, there is provided an electrical connector, including:

(a) insulation displacement contacts for making electrical contact to conductors of electrically insulated wires by effecting relative movement between the conductors and the insulation displacement contacts; and (b) a control circuit for controlling operation of one or more electric devices also electrically connected to said conductors.

Preferably, the control circuit includes a switch.

Preferably, the switch is located remotely from a main body portion of the connector.

BRIEF DESCRIPTION OF THE DRAWINGS

The invention is further described, by way of example only, with reference to the accompanying drawings, in which.

DETAILED DESCRIPTION OF PREFERRED EMBODIMENTS OF THE INVENTION

Figure 1:
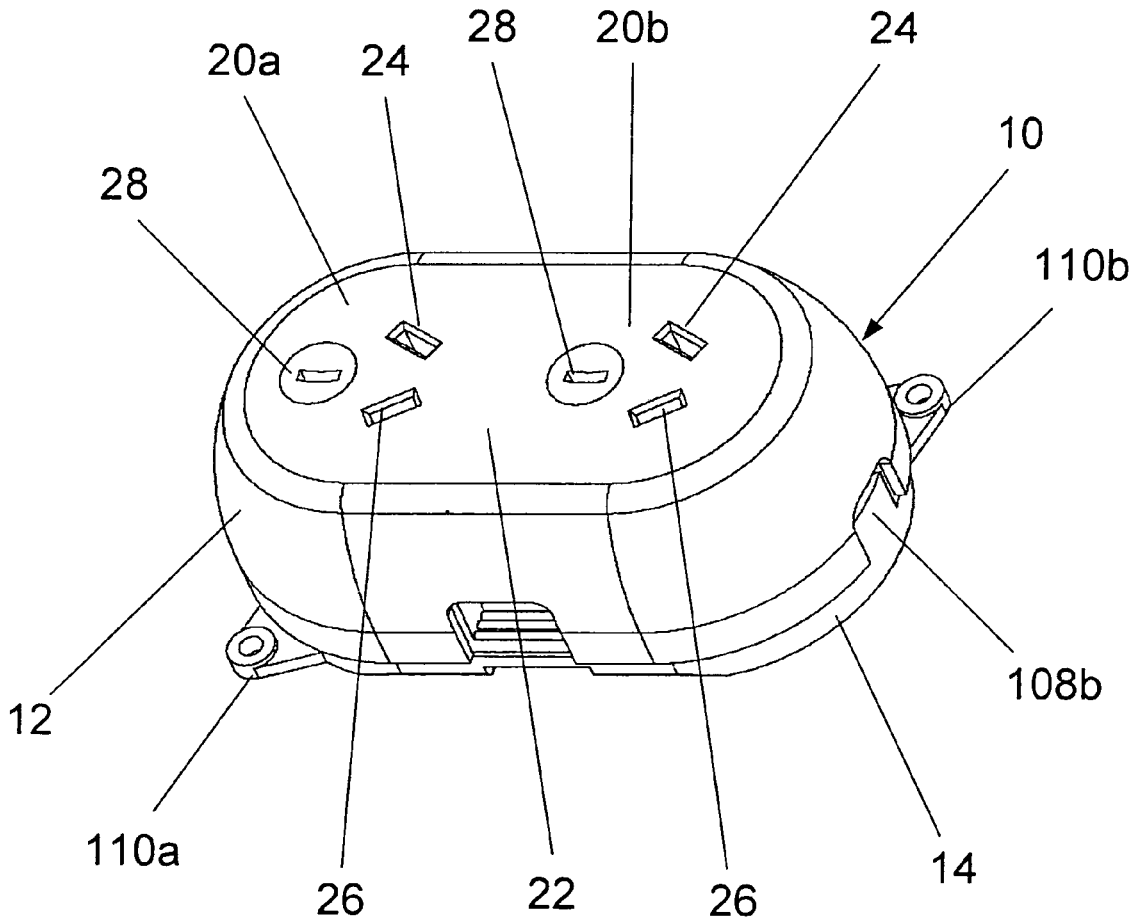
FIG. 1 is a perspective view of an electrical connector.
Figure 2:
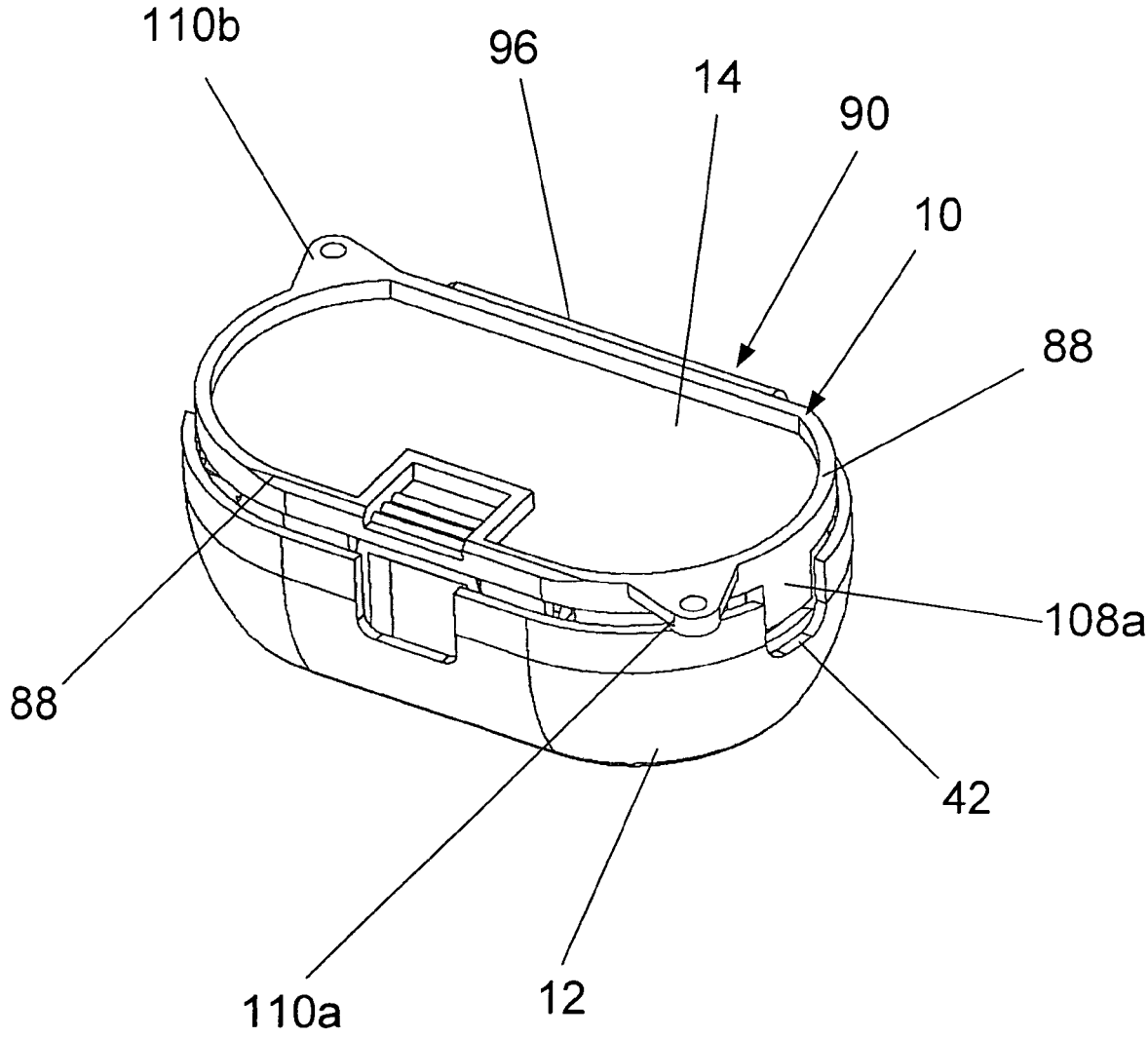
FIG. 2 is another perspective view of the electrical connector shown in FIG. 1.
Figure 3:
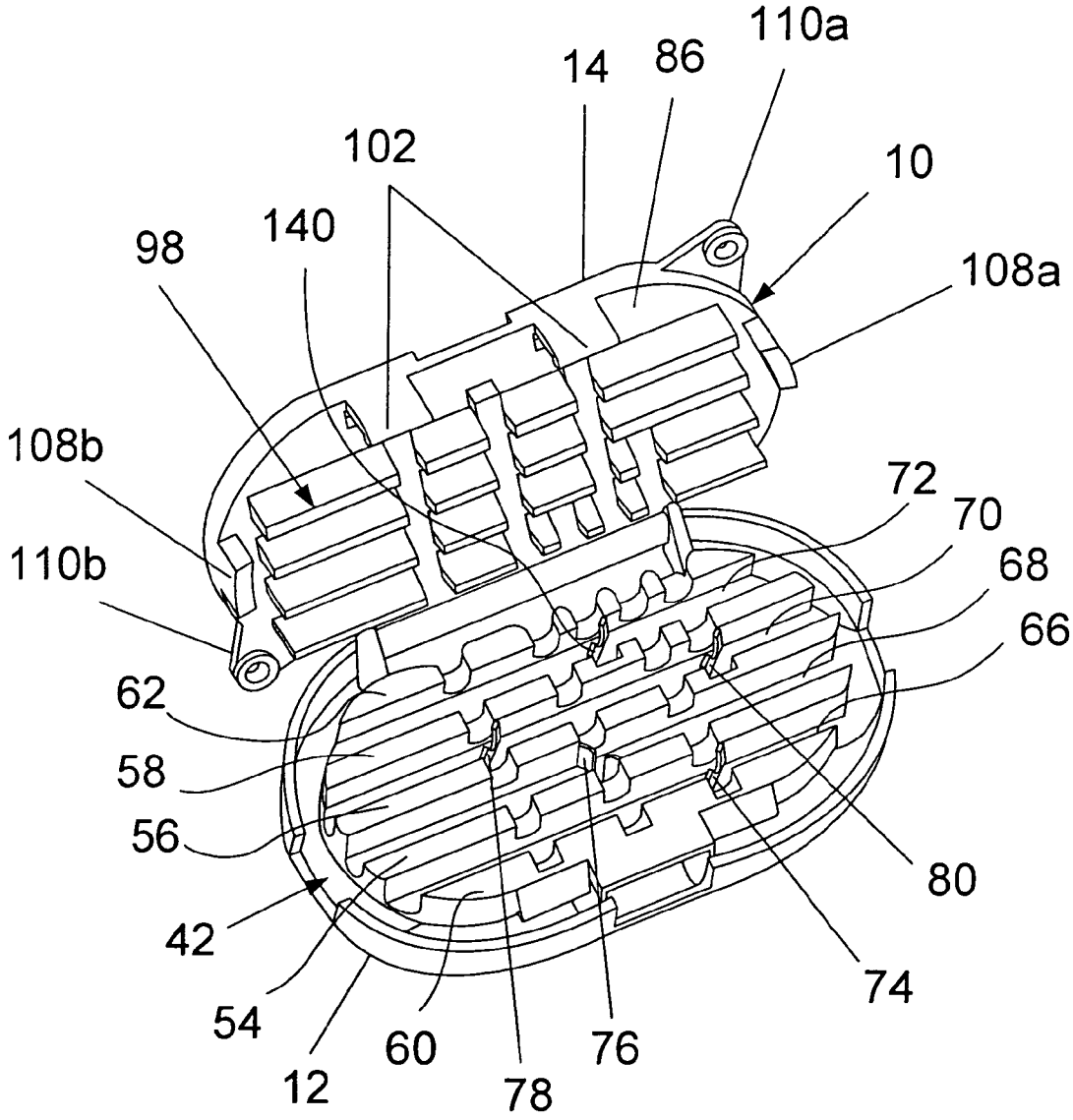
FIG. 3 is a perspective view of the connector of FIG. 1 arranged in an open condition of use.

The connector 10 shown in FIGS. 1 and 2 includes two parts 12 and 14 which are hinged together so that they may be manipulated between the condition shown in FIGS. 1 and 2, at which the connector 10 is in a closed condition for use, and the condition shown in FIG. 3, at which the connector 10 is in an open position, for connection to electrical conductors of an electrical cable (not shown).

Figure 4:
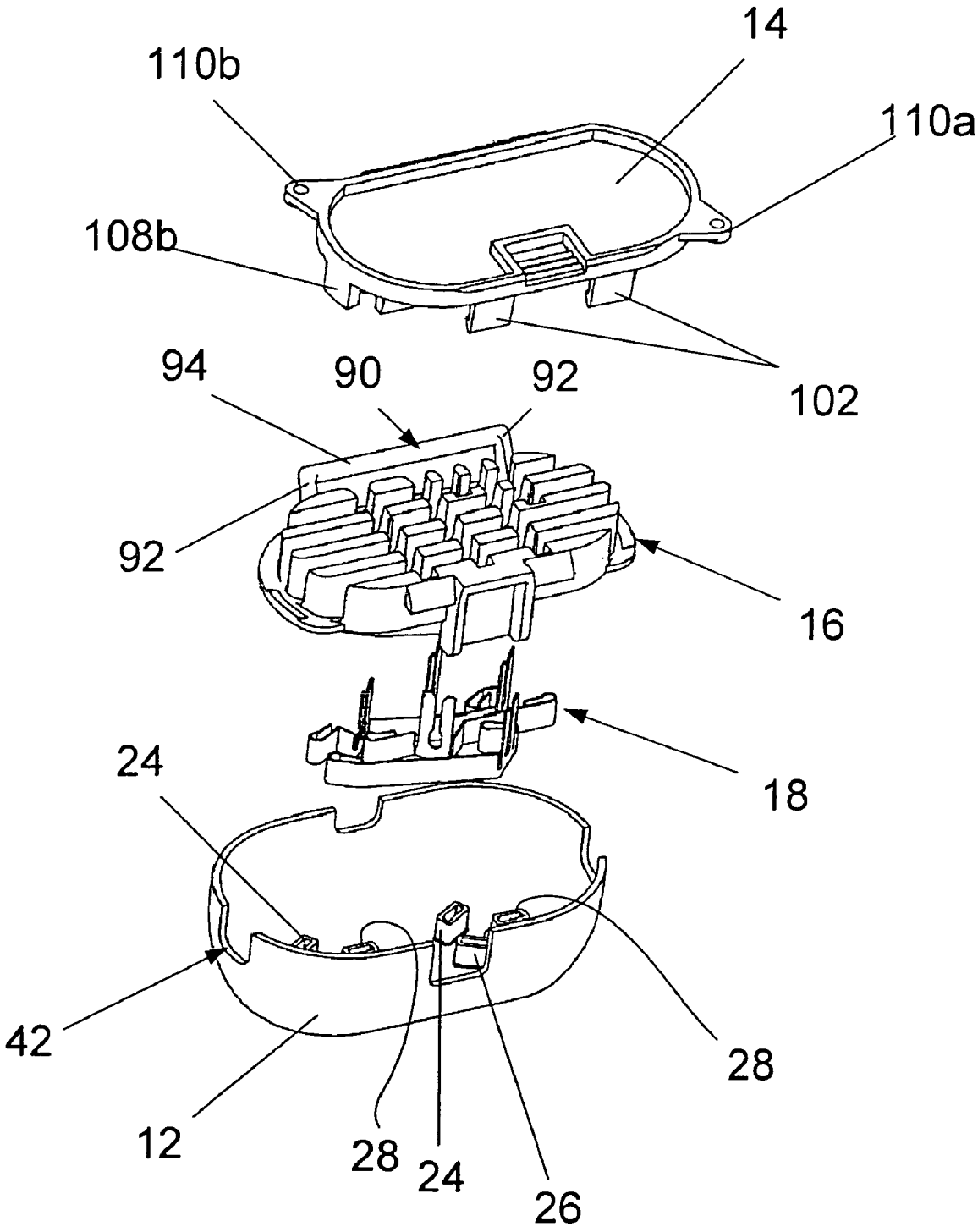
FIG. 4 is an exploded view of the connector shown in FIG. 1.

The electrical connector 10 includes a wire channel plate 16 and a set of electrical contact elements 18 seated in the part 12 in the manner shown in FIG. 4, where the set of contact elements 18 is interposed between the part 12 and the wire channel plate 16. The wire channel plate 16 and the set of contact elements 18 are housed within the parts 12, 14 when the parts 12, 14 are arranged in a closed condition of use, as shown in FIGS. 1 and 2.

Part 12 of connector 10 is formed of electrically insulate material. It has first and second electrical power sockets 20*a*, 20*b* arranged side by side on a generally planar exterior surface 22 of the part 12. Each power socket 20*a*, 20*b* includes three apertures 24, 26, 28 that are each shaped to receive conductive pins of an electric power plug (not shown). For example, the apertures 24, 26, 28 are shaped to respectively receive the active, neutral and earth pins of the electric power plug.

The set of electrical contact elements 18 includes:

1. An active contact element 30;
2. A neutral contact element 32; and
3. An earth contact element 34.

Figure 5:
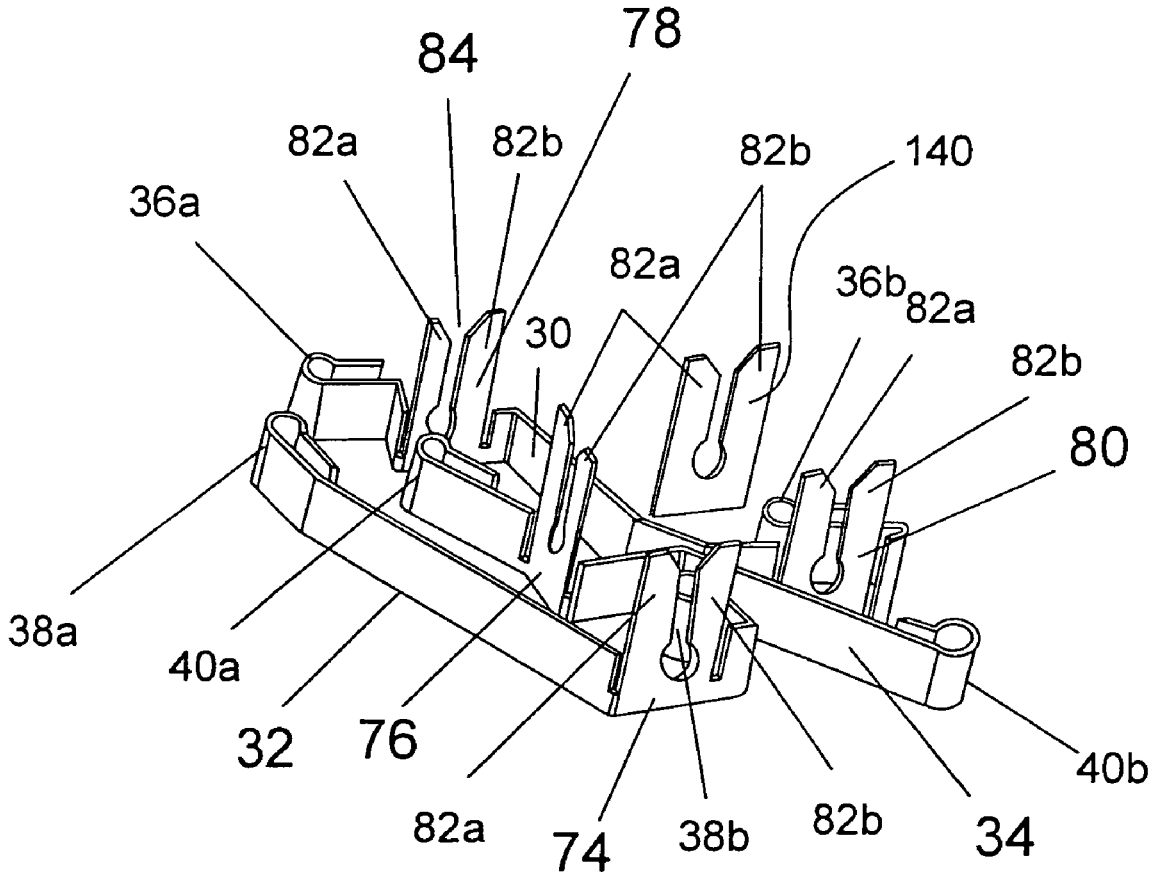
FIG. 5 is a perspective view of a set of electrical contact elements of the connector shown in FIG. 1.

As particularly shown in FIG. 5, the active contact element 30 includes two end portions 36*a*, 36*b* which are located within part 12 behind the active apertures 24 of the first and second power sockets 20*a*, 20*b*. The end portions 36*a*, 36*b* of the active contact element 30 are arranged to make electrical connection with the active pins of electrical power plugs (not shown) as they pass through the active apertures 24 of the electrical power sockets 20*a*, 20*b*. The end portions 36*a*, 36*b* are electrically connected by an elongate strip of electrically conductive material extending therebetween.

The neutral contact element 32 includes two end portions 38*a*, 38*b* which are located within part 12 behind the neutral apertures 26 of the first and second power sockets 20*a*, 20*b*. The end portions 38*a*, 38*b* of the neutral contact element 32 are arranged to make electrical connection with the neutral pins of electrical power plugs (not shown) as they pass through the neutral apertures 26 of the sockets 20*a*, 20*b*. The end portions 38*a*, 38*b* are electrically connected by an elongate strip of electrically conductive material extending therebetween.

The earth contact element 34 includes two end portions 40*a*, 40*b* which are located within part 12 behind the earth apertures 28 of the first and second power sockets 20*a*, 20*b*. The end portions 40*a*, 40*b* of the earth contact element 34 are arranged to make electrical connection with the earth pins of electrical power plugs (not shown) as they pass through the earth apertures 28 of the sockets 20*a*, 20*b*. The end portions 40*a*, 40*b* are electrically connected by an elongate strip of electrically conductive material.

Part 12 has, at a face thereof opposite the power socket 20*a*, 20*b*, a cable channel 42 which is open to that opposite face, and which extends lengthwise from side-to-side of the part 12. Cable channel 42 has parts at the ends thereof which are sized so as to neatly accommodate spaced portions a double insulated electrical cable 44 which may be laid therein in the manner shown in FIG. 6. The cable 44 has therewithin three wires 46, 48, 50 which each have inner conductors and outer surrounding insulation. These wires 46, 48, 50 are arranged side-by-side within an outer cover 52 of the cable 44. Prior to fitting the cable in the cable channel 42, part of the outer cover 52 is removed, over the length labelled "L" in FIG. 6 so that, over this length "L", the three insulated wires 46, 48, 50 have no cover 52 over them, but the inner conductors still retain their insulation.

The wire channel plate 16 includes first 54, second 56 and third 58 walls upstanding from a base section of the plate 16 that extend along the cable channel 42, in the manner shown in FIG. 3. The walls 54,56, 58 are generally parallel to the length of the cable channel 42, and are positioned at an intermediate part of the cable channel 42, along the length thereof. The first wall 54 is adjacent to, but spaced from, an upstanding side wall portion 60 of cable channel 42. The second wall 56 is adjacent to, but spaced inwardly from, the first wall 54. The third wall 58 is adjacent to, but spaced inwardly from, the second wall 56. Similarly, the third wall 58 is adjacent to, but spaced inwardly from, the second wall 56. The third wall is also spaced apart from an opposite sidewall portion 62 of cable channel 42. The spacing between adjacent walls 54, 56, 58, 60, 62 is generally the same, and substantially equal to the diameter of the insulated wires 46, 48, 50. The side wall portion 60 and the first wall 54 define therebetween a neutral wire channel 66; the first wall 54 and the second wall 56 define therebetween an earth wire channel 68; the second wall 56 and the third wall 58 define therebetween an active wire channel 70; and the third wall portion 58 and the opposite side wall portion define therebetween a control wire channel 72.

Disposed within the lengthwise extending wire channels 66, 68, 70, 72 are insulation displacement contacts (IDCs) 74, 76, 78, 80, 140. These IDCs form part of the set of contact elements 18. The first IDC 74 is electrically coupled to the neutral contact element 32; the second IDC 76 is electrically coupled to the earth contact element 34; and the third and fourth IDCs 78, 80 are electrically coupled to the active contact element 30. The fifth IDC 140 is electrically electrically isolated from the other contact elements 30, 32, 34. The IDC 140 is used to couple the connector to a control circuit. The operation of the control circuit is described in detail below.

Each insulation displacement contact 74, 76, 78, 80, 140 is formed as a generally upstanding planar conductive portion of the respective contact element, being bifurcated so as to form two opposed upstanding contact portions 82*a*, 82*b* which are separated by an upwardly open space 84. The spacing between the contact portions 82*a*, 82*b* is such as to be slightly less than the diameter of the inner conductors of the wires 46, 48, 50.

Part 14 of the electrical connector 10 is formed of electrically insulative material and has an elongate somewhat planar form, shaped such that it can be positioned over the top of part 12 so as to close the cable channel 42 at the open side thereof. It thus has a generally elongate planar roof portion 86 with side rim portions 88 extending along opposed side-to-side edges thereof.

Restraining means, in the form of a hinge 90 is provided for pivotally coupling parts 12, 14 together. Thus, part 12 has two sidewardly extending lugs 92 between which extends a hinge pin 94. The axis of this hinge pin 94 is arranged to be generally parallel to, and to one side of, the cable channel 42 and lengthwise extending wire channels 66, 68, 70. Part 14 has at one side thereof a part-tubular elongate portion 96 of length only slightly less than the length of pin 94. The part-tubular elongate portion 96 has a lengthwise extending inner part-tubular portion, of side-to-side width slightly less than the diameter of the pin 94. The part-tubular portion 96 is of sufficient flexibility and resilience that it can be attached to the hinge pin 94 by aligning its opening with the pin axis, and then pressing the portion 96 with respect to the pin 94. After this, due to natural resilience, the pin 94 is captured in the portion 96 for rotation of the part 14 with respect to the part 12, about the axis of the pin 94. FIGS. 1 and 2 show the parts 12, 14 in closed condition; and FIG. 3 shows the parts 12, 14 in a closed condition.

At a portion of the part 14, on the side thereof which is innermost when parts 12 and 14 are in the closed condition, there are a plurality of lengthwise extending projections 98. In the closed position, the projections 98, reckoned in the lengthwise direction of the cable channel 42, are brought to positions where they are located over, and at least partially within, respective ones of the lengthwise extending wire channels 66, 68, 70, 72. When the parts 12, 14 are hinged to the closed position, the projections 98 are likewise located in respective ones of the lengthwise extending wire channels 66, 68, 70, 72.

Figure 6:
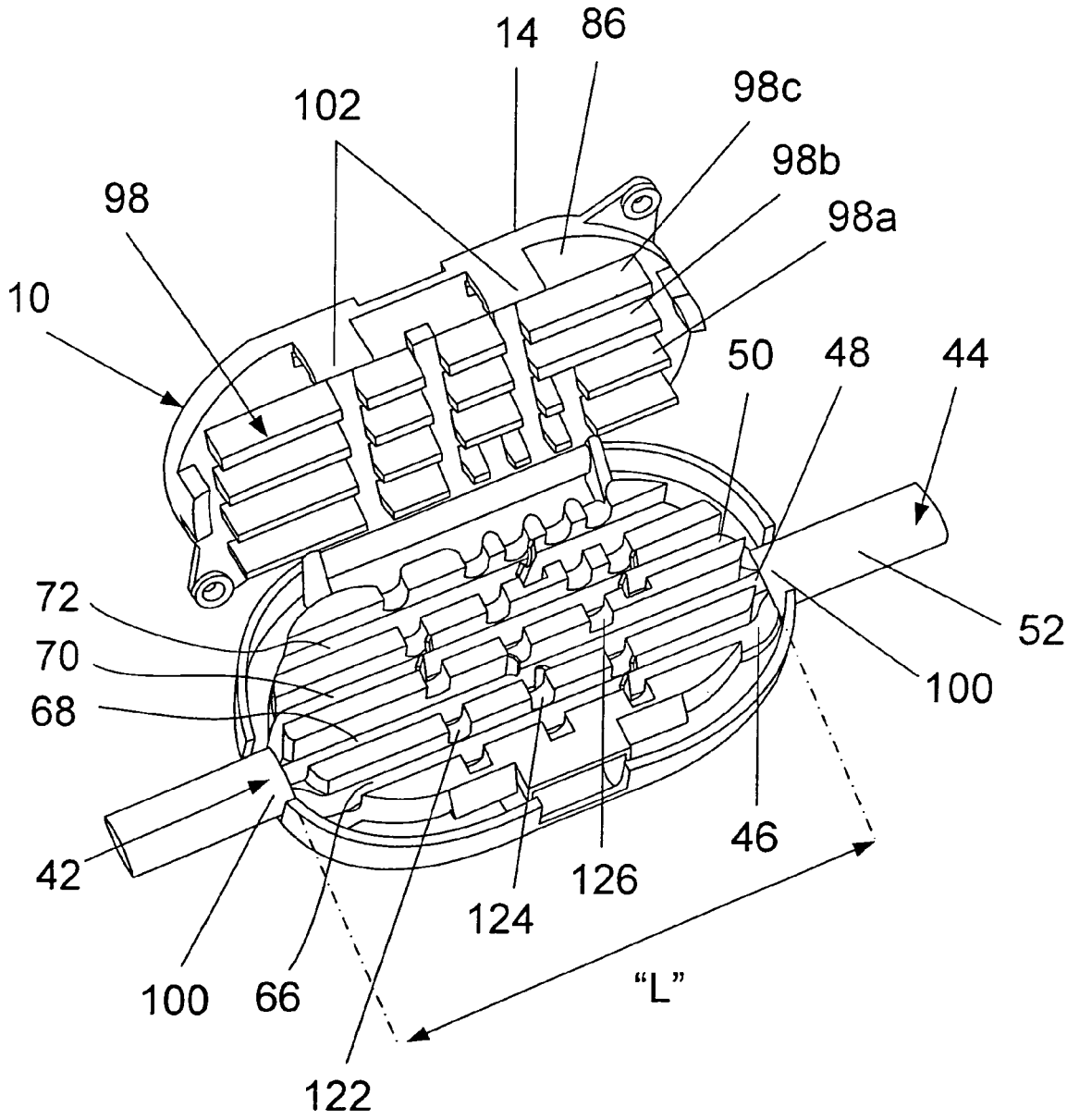
FIG. 6 is a perspective view of the electrical connector shown in FIG. 3 electrically coupled to a double insulated electrical cable.

The following steps are performed to use the connector 10 to coupled the power socket 20*a*, 20*b* to the cable 44:

1. The connector 10 is arranged in the open position shown in FIGS. 1 and 2, where the part 14 is swung clear of the cable channel 42;
2. The cable 44, having the above-described portion of its outer cover 52 removed, is laid in the cable channel 42, as shown in FIG. 6, so that end portions 100 of the outer covering 52 of the cable 44 are positioned within outer end portions of the cable channel 42;
3. The wires 46, 48, 50 are positioned so as to extend over respective ones of the first, second and third lengthwise extending wire channels 66, 68, 70;
4. The wires 46, 48, 50 are then lightly pressed into the first, second and third lengthwise extending wire channels 66, 68, 70;
5. The part 14 is swung about the axis of the pin 94 so that it overlies the part 12 and so that the projections 98 engage the wires 46, 48, 50 and press them into their respective channels 66, 68, 70; and
6. Part 14 is then pressed fully down so that portions of the part 14 away from the hinge axis are firmly engaged with the part 12.

Figure 7:
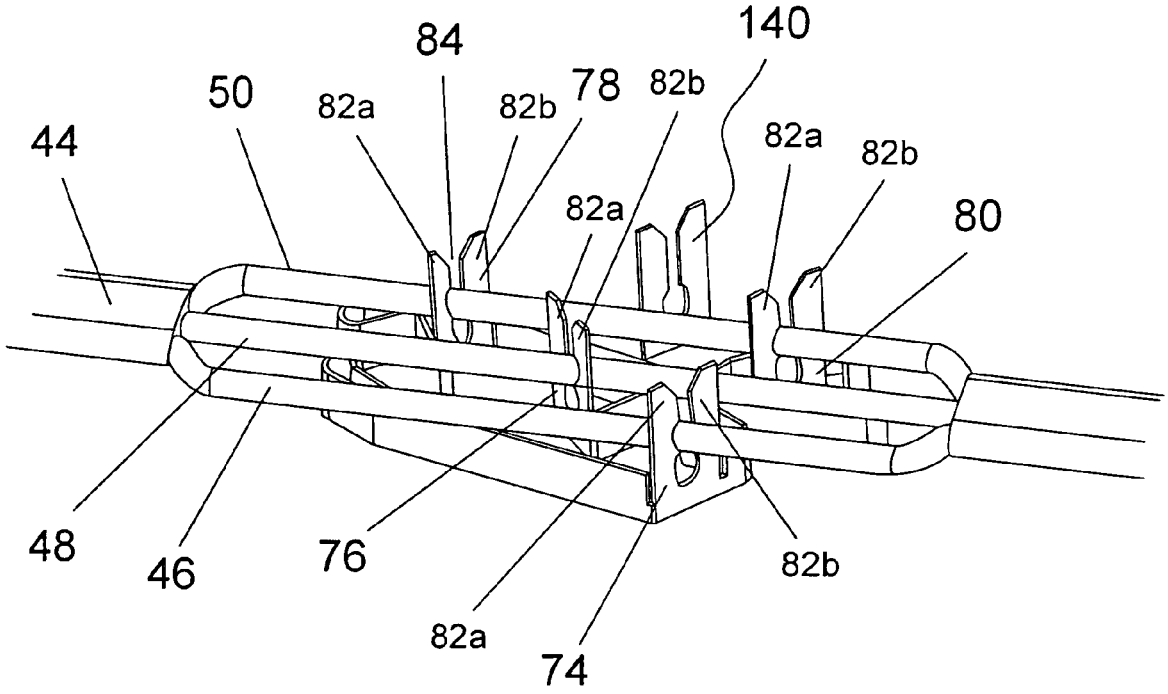
FIG. 7 is a perspective view of the set of electrical contacts shown in FIG. 5 electrically coupled insulated wires of the double insulated electrical cable in the manner shown in FIG. 6.

During the described closing action, the projections 98 bear against portions of the wires 46, 48, 50 and force them into corresponding insulation displacement contacts 74, 76, 78, 80. In doing so, the insulation of the wires 46, 48, 50 is cut by the insulation displacement contacts 74, 76, 78, 80, and the internal conductors are forced into electrically conductive connection with the insulation displacement contact, as shown in FIG. 7. That is, the wires 46, 48, 50 are pressed into the space between the upstanding contact parts 82*a*, 82*b* of the insulation displacement contacts 74, 76, 78, 80, and are firmly engaged by these. Also during the above process, the projections 98 press down upon the wires 46, 48, 50 to further assist in locating these in the channels 66, 68, 70. The electrical connector 10 need only be terminate once to provide a double socket outlet.

As will be observed particularly from FIG. 6, that because a rotary action about an axis offset from, but generally parallel to, the direction of extent of the cable 44 is used to bring the projections 98 into engagement with the wires 46, 48, 50 for pressing these into the channels 66, 68, 70, at least initially, contact between the projections 98 and respective ones of the wires does not occur all at once. That is to say, at first the projection 98*a* is brought into contact with the wire 50 located in the third channel 70; then the projection 98*b* is brought in to contact with the wire 48 located in the second channel 68; and, lastly, the projection 98*c* is brought into contact with the wire 46 located in the first channel 66. As a result, the wires are forced into the IDCs 74, 76, 78, 80 sequentially, and the forces which need to be applied to effect the making of electrical connection to the IDCs 74, 76, 78, 80 are also sequentially applied. By this, at any one time, it is sufficient to generally apply a force which would be enough to force only one wire at a time into position.

As shown in FIGS. 1 and 2, the parts 12, 14 may be latched in the closed position by resilient clips 102 coupled to the part 14 which releasably grip corresponding portions of the part 12. The parts 12, 14 can otherwise be fastened together using any other suitable means.

The part 14 includes first and second cable restraining flanges 108*a*, 108*b* arranged at opposite ends of the part 14. The flanges 108*a*, 108*b* extend from the planar roof portion 86 towards the end portions 100 of the outer covering 52 of the cable 44 when the connector is arranged in the closed position shown in FIG. 1. When so arranged, the flanges 108*a*, 108*b* bear against respective end portions 100 of the cable 44 and inhibit movement of the cable 44 in direction "L". The flanges thereby reduce wear and tear on the electrical connections formed by the IDCs 74, 76, 78, 80 with the wires 46, 48, 50.

The connector 10 described is useful as a general purpose outlet for supply of electricity via the set of contact elements 18 from cable 44 to electrical devices which may be plugged into the sockets 20*a*, 20*b*. However, the invention may be applied to other types of connector.

While, in the described connector 10, the parts 12, 14 are connected together for relative swinging movement by restraining means formed as a simple hinge having the hinge pin 94 and cooperating part tubular portion 96, other forms of restraining means may be employed. For example, the parts 12, 14 may be integrally moulded with a connecting flexible hinge element.

While it has been found useful to align the planes of the insulation displacement contacts 47, 76, 78, 80 angularly with respect to the directions of extent of lengthwise extending wire channels 66, 68, 70 (at 45° in the illustrated embodiment) this is not necessarily essential to the invention.

The electrical connector 10 also includes two lugs 110*a*, 110*b* coupled to and extending from opposite ends of the part 14. The lugs 110*a*, 110*b* include apertures through which screws or nails can be driven to secure the connector to a wall surface, for example. The connector 10, alternatively include three or four lugs to secure the connector to the mentioned wall surface.

Figure 8:
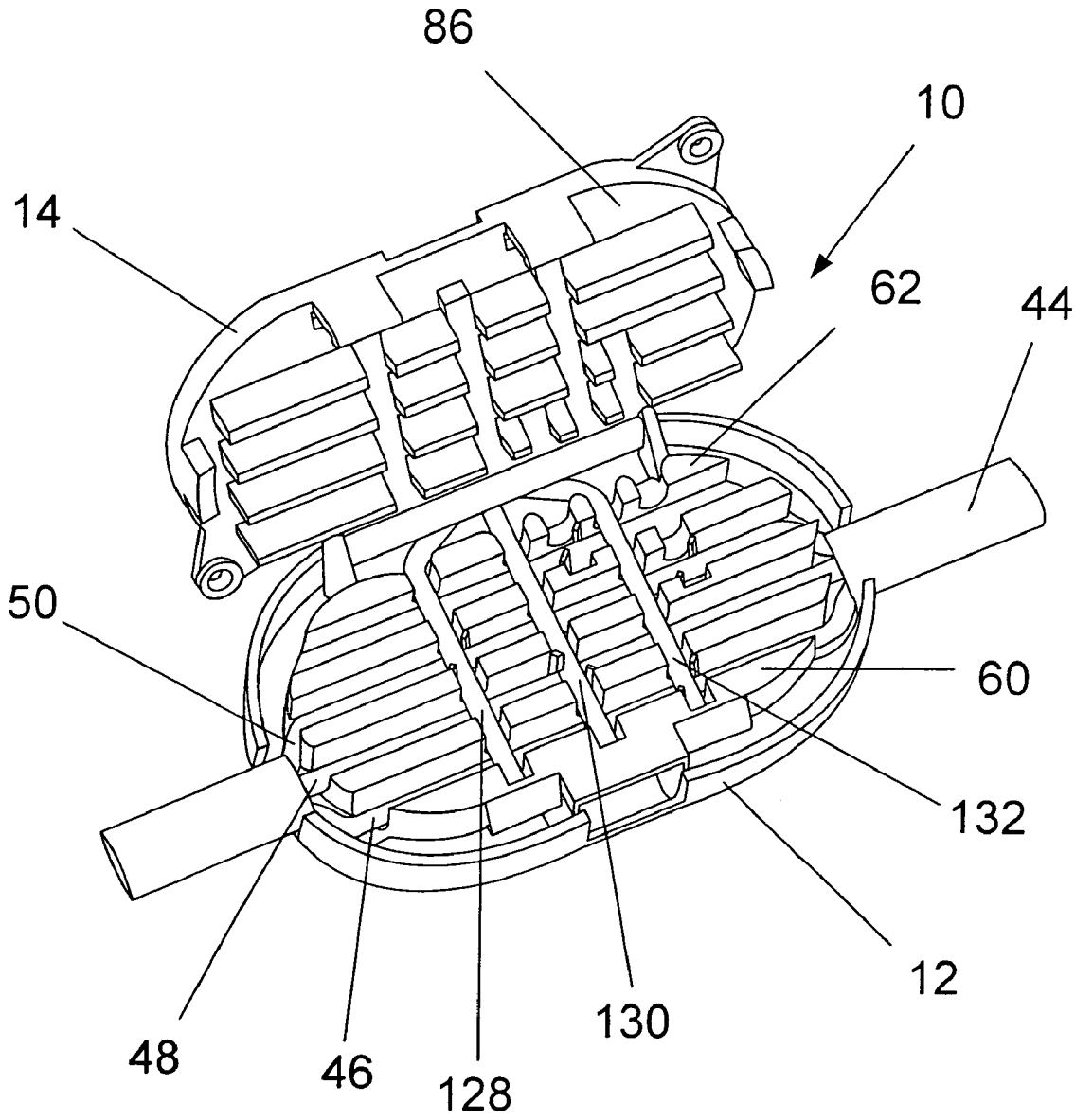
FIG. 8 is a perspective view of the electrical connector shown in FIG. 6 electrically coupled to another double insulated electrical cable.
Figure 9:
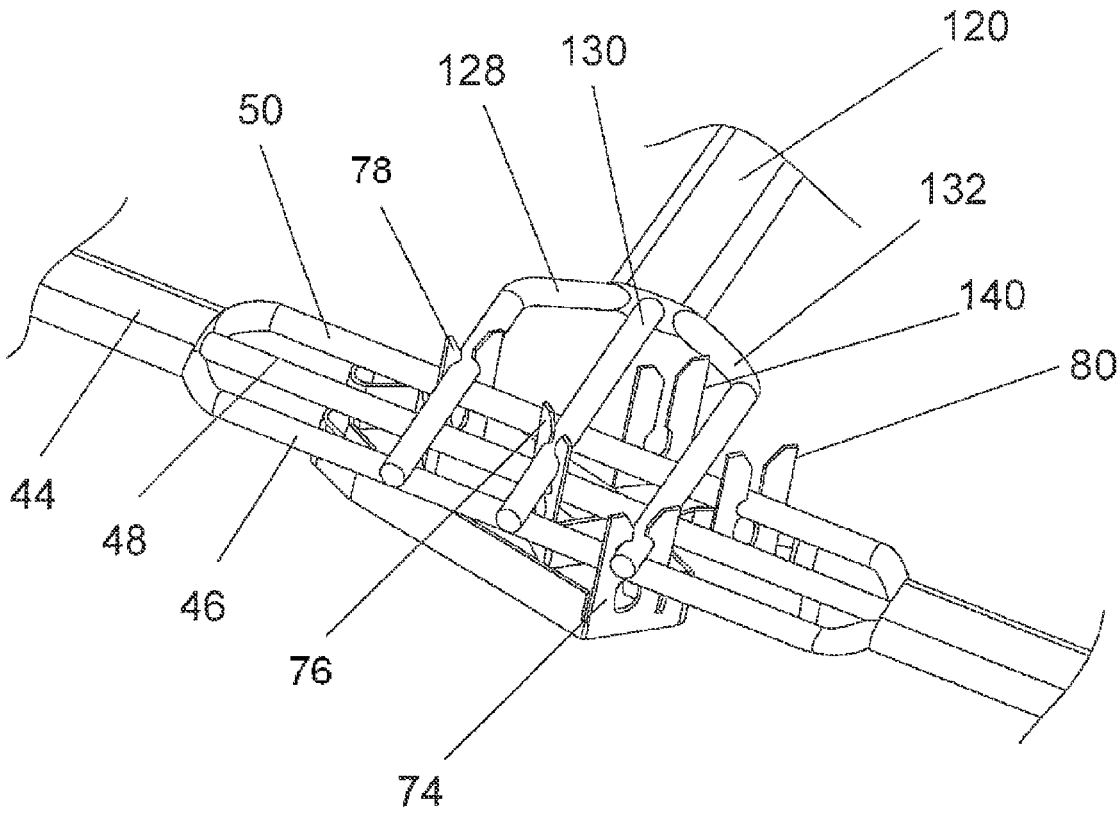
FIG. 9 is a perspective view of the set of electrical contact elements shown in FIG. 7 electrically coupled to another double insulated electrical cable in the manner shown in FIG. 8.

The connector 10 can be used to effect a straight through connection for the electrical power sockets 20*a*, 20*b*. The connector 10 can also be used to effect a "T" connection for a second double insulated cable 120 at right angles to the first one 44, as shown in FIGS. 8 and 9.

As particularly shown in FIG. 6, the wire channel plate 16 of the part 12 includes transverse wire channels 122, 124, 126 that intersect the lengthwise extending wire channels 66, 68, 70, 72 at an angle of 90 degrees, for example. In the illustrated example, the transverse wire channels 122, 124, 126 overlie the lengthwise extending wire channels 66, 68, 70. Alternatively, the transverse wire channels 122, 124, 126 could underlie the lengthwise extending wire channels 66, 68, 70. The transverse wire channels 122, 124, 126 are generally parallel and extend through the opposite side wall portion 62 of part 12 and terminate in the side wall portion 60 of the part 12. The width of the transverse wire channels 122, 124, 126 approximates the width of the insulated wires 128, 130, 132 of the second double insulated cable 120.

The IDCs 74, 76, 78, 80 are located at intersections of the transverse wire channels 122, 124, 126 and the lengthwise extending wire channels 66, 68, 70 for electrically connecting the conductors 128, 130, 132 seated in the transverse wire channels 122, 124, 126 with respective ones of the conductors 46, 48, 50 seated in the lengthwise extending wire channels 66, 68, 70. For example, the wire channel plate 16 has the following configuration:

1. The transverse active wire channel 122 passes through the insulation displacement contact 78 located in the active wire channel 70 of the part 12;
2. The transverse earth wire channel 124 passes through the insulation displacement contact 76 located in the earth wire channel 68 of the part 12; and
3. The transverse neutral wire channel 126 passes through the insulation displacement contact 74 located in the neutral wire channel 66 of the part 12.

Figure 10:
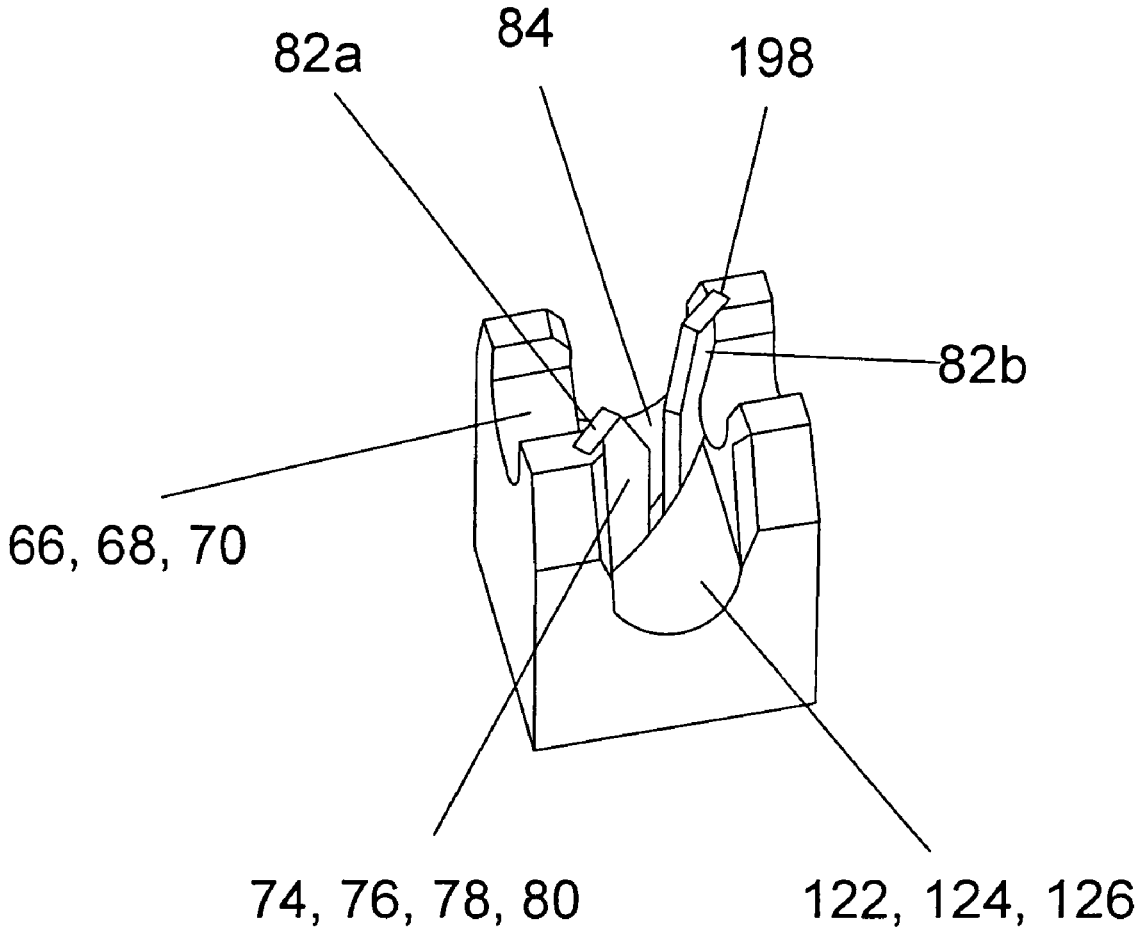
FIG. 10 is a sectioned view of part of the wire channel plate of the electrical connector shown in FIG. 1.

The insulation displacement contacts 74, 76, 78, 80 are held within a side-to-side elongate slots 198 formed in the wire channel plate 16 at intersections of the transverse wire channels 122, 124, 126 and the lengthwise extending wire channels 66, 68, 70, as shown in FIG. 10. The slot 198 extends through the plate 16 from an upper surface to a bottom surface. Viewed from above the slot 198 extends with its longer cross-sectional dimension arranged at 45° to the directions of extent of both the transverse channel 122, 124, 126 and the lengthwise extending wire channel 46, 66, 68 and crosses and breaks into these. The insulation displacement contact 74, 76, 78, 80 is thus located within slot 198 so that the side to side direction of the slot 84 of the IDC is substantially 45 degrees to the direction of extent of the lengthwise extending wire channel 66, 68, 70 and substantially 45 degrees to the direction of extent of the transverse wire channel 122, 124, 126. The upstanding contact portions of the IDCs 74, 76, 78, 80 are disposed within channels.

The insulated wire 128, 130, 132 of the second cable 120 can be electrically coupled to corresponding insulated wire 46, 48, 50 of the first cable 44 by performing the following steps to effect the "T" connection:

1. The connector 10 is arranged in the position shown in FIGS. 1 and 2, that is in an open condition where the part 14 is swung clear of the cable channel 42;
2. The first cable 44, having the above-described portion of its outer cover 52 removed, is laid in the cable channel 42, as shown in FIG. 6, so that end portions 100 of the outer covering 52 of the cable 44 are positioned within outer end portions of the cable channel 42;
3. The wires 46, 48, 50 are positioned so as to extend over respective ones of the first, second and third lengthwise extending wire channels 66, 68, 70;
4. The wires 46, 48, 50 are then lightly pressed into the first, second and third lengthwise extending wire channels 66, 68, 70;
5. The outer cover of a terminal end of the second cable 120 is removed exposing a length of the terminal ends of the active, neutral and earth insulated wires 128, 130, 132;
6. The wires 128, 130, 132 are inserted into their respective transverse wire channels 122, 124, 126 through the opposite side wall portion 62 of the part 12 so that they overlie and intersect the active, earth and neutral wires 46, 48, 50 of the first cable 44;
7. The wires 128, 130, 132 are then lightly pressed into the transverse wire channels 122, 124, 126;
8. The part 14 is swung about the axis of the pin 94 so that it overlies the part 12 and so that the projections 98 engage the wires 46, 48, 50 and press them into their respective channels; and
9. Part 14 is then pressed fully down so that portions of the part 14 away from the hinge axis are firmly engaged with the part 12.

During the described closing action, the projections 98 bear against portions of the wires 46, 48, 50 and force them into the insulation displacement contacts 74, 76, 78, 80. In doing so, the insulation of the wires 46, 48, 50 is cut by the insulation displacement contacts 74, 76, 78, 80, and the internal conductors are forced into electrically conductive connection with the insulation displacement contact, as shown in FIG. 7. That is, the wires 46, 48, 50 are pressed into the space between the upstanding contact parts 82*a*, 82*b* of the insulation displacement contacts 74, 76, 78, 80, and are firmly engaged by these. Also during the above process, the projections 98 press down upon the wires 46, 48, 50 to further assist in locating these in the channels 66, 68, 70.

As part 14 is closed over part 12, the elongate planar roof portion 86 bears against the transverse wires 128, 130, 132 and forces them into respective ones of the insulation displacement contacts 74, 76, 78 as shown in FIG. 9. Thus, the transverse wires 128, 130, 132 are electrically coupled to respective ones of the wires 46, 48, 50 of the first cable 44.

Relative movement of the upstanding contact portions 82*a*, 82*b* of the insulation displacement contacts 74, 76, 78, 80, 140 when the conductors are forced therebetween in the above described manner is limited by the shape of the slots 198 within which they are seated. The slots 198 thereby assist the process of making good electrical connections between multiple conductors.

As above-mentioned, the parts 12, 14 may be latched in the closed position by resilient clips 102 coupled to the part 14 which releasably grip corresponding portions of the part 12. The parts 12, 14 can otherwise be fastened together using any other suitable means.

Control Circuit

Figure 11:
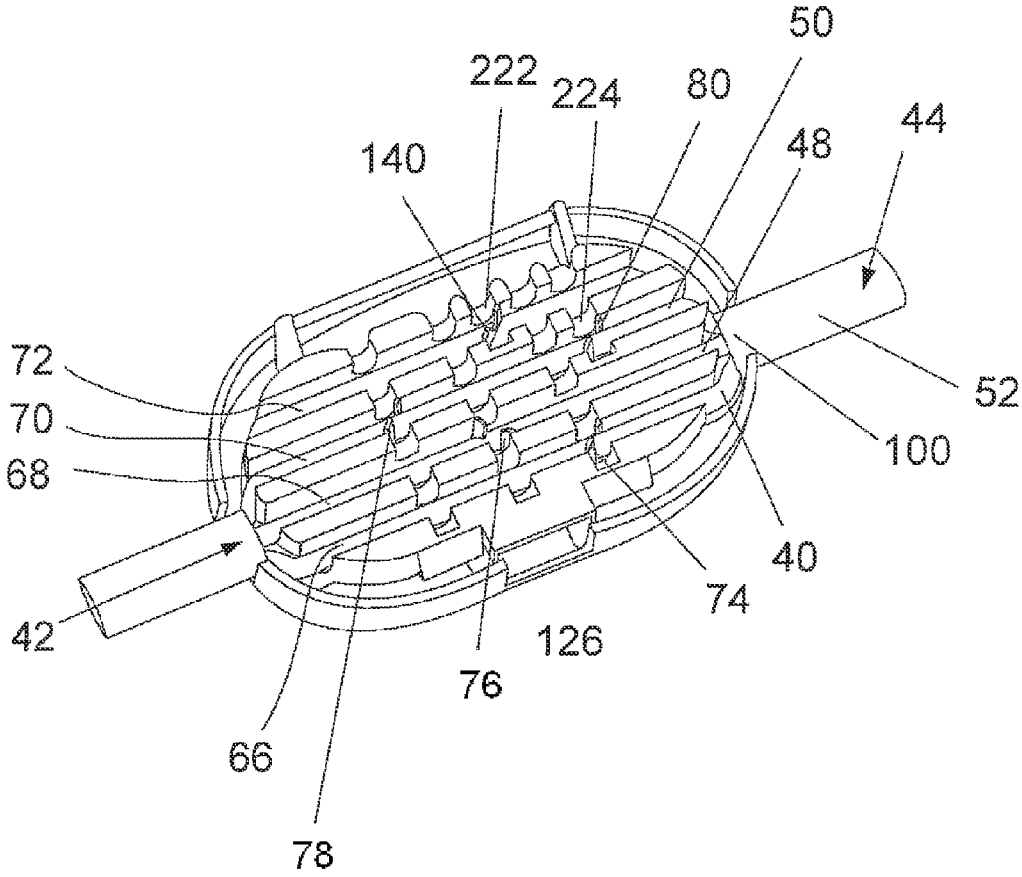
FIG. 11 is a perspective view of a part of the connector electrically connected to a power cable.

As above-mentioned, the connector 10 also includes a spare insulation displacement contact 140 seated in the control wire channel 72, as shown in FIG. 11. The spare IDC 140 allows the connector to interface with a control circuit 200. The control circuit 200 can be used to:

1. Control the electrical power outlets 20*a*, 20*b* of connector 10 and other electric devices also electrically connected to the power cable 44;
2. Control other electric devices also electrically connected to the power cable 44;
3. Control the electrical power sockets 20*a*, 20*b* of the connector 10 without interrupting power supply for other electric devices also electrically connected to the cable 44.

A description of the operation of the above configurations of the control circuit 200 and the connector 10 is set out below.

1. Control the electrical power outlets 20*a*, 20*b* of connector 10 and other electric devices also electrically connected to the power cable 44.

Figure 12:
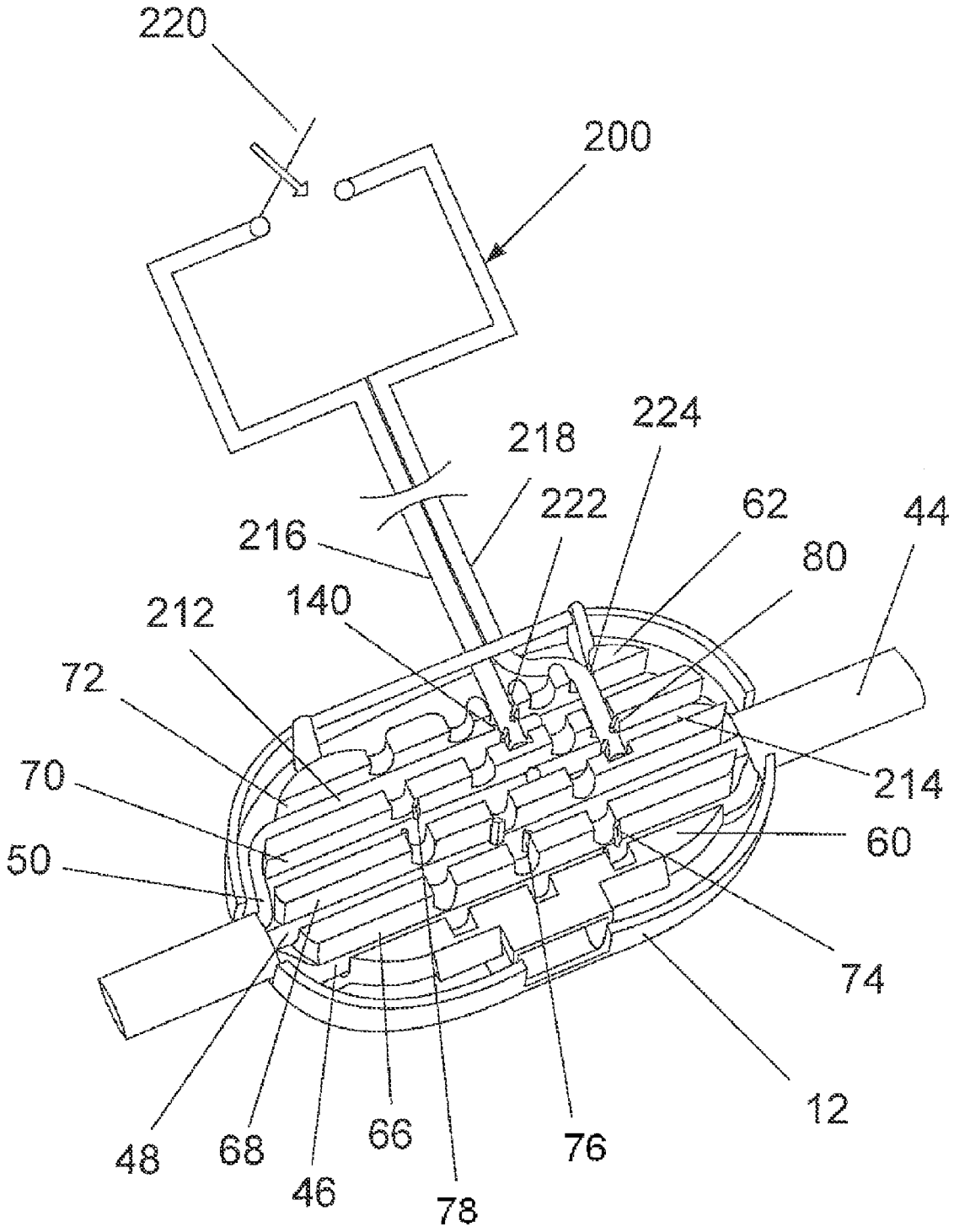
FIG. 12 is a perspective view of the part shown in FIG. 11 electrically connected to a power cable and to a control circuit.

The connector 10 shown in FIG. 12 is coupled to the control circuit 200. The circuit 200 is used to control the operation of the electrical power sockets 20*a*, 20*b* of the connector 10 and the operation of any other electric devices, such as additional connectors, electrically connected to the power cable 44.

In the arrangement shown, the active wire 50 of the power cable 44 has been cut. A first section 212 of the cut active wire 50 extends into, and is seated in, a left hand side of the control channel 72. An end portion of the first section 212 of the active wire 50 overlies the spare IDC 140. The first section 212 of the active wire 50 can thereby be electrically connected to the spare IDC 140. A second section 214 of the active wire 50 extends into, and is seated in, a right hand side of the active wire channel 70. An end portion of the second section 214 of the active wire 50 overlies the IDC 80. The second section 214 of the active wire 50 can thereby be electrically connected to the active IDC 80. The earth and neutral wires 48, 46 are respectively arranged in the earth and neutral wire channels 68, 66.

The control circuit 200 includes first and second insulated conductors 216, 218 electrically connected to respective sides of a switch 220. An end section of the first insulated conductor 216 extends into a spare traverse wire channel 222 through an opening in the opposite sidewall portion 62. The end section of the first insulated conductor 216 overlies the spare IDC 140. The first insulated conductor 216 can thereby be electrically connected to the spare IDC 140. Similarly, an end section of the second insulated conductor 218 extends into another traverse wire channel 224 through an opening in the opposite sidewall portion 62. The end section of the second insulated conductor 218 overlies the active IDC 80. The second insulated conductor 218 can thereby be electrically connected to the active IDC 80.

When the part 14 is closed over the part 12 in the above-described manner, the insulated conductors 46, 48, 212, 214, 216, 218 are forced into respective ones of the IDCs 74, 78, 140, 80, 140, 80 by corresponding lengthwise extending projections 98.

The first section 212 and the second section 214 of the active wire 50 are thereby electrically connected by way of the control circuit 200. When the switch 220 is open, the active wire 50 is incomplete and the active contact element 30 of the connector 10 is electrically isolated. As such, the electrical power sockets 20*a*, 20*b* are inactive and all electric equipment connected to the power cable 44 after the connector 10 is also inactive. Alternatively, when the switch 220 is closed, the active wire 50 is complete and the active contact element 30 of the connector 10 is electrically charged. As such, the electrical power sockets 20*a*, 20*b* are active and all electric equipment connected to the power cable 44 after the connector 10 is also active.

For example, if a number of connectors 10 were fitted in series to the one length of power cable 44 to power a row of fluorescent lights, then the lights could all be turned on or off using a control circuit 200 connected to the first connector 10 in the series.

2. Control the electric devices also electrically connected to the power cable 44.

Figure 13:
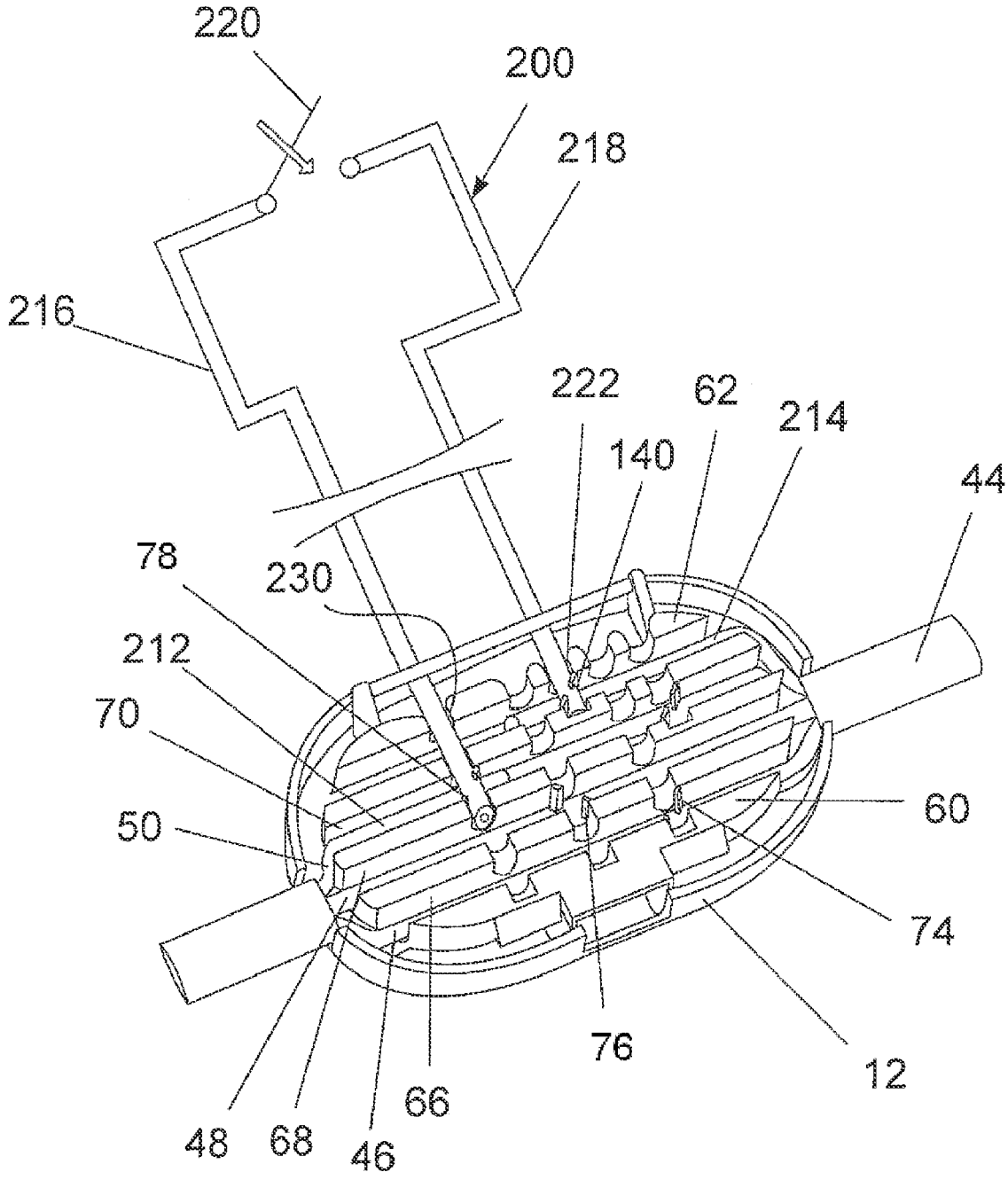
FIG. 13 is a perspective view of the part shown in FIG. 11 electrically connected to a power cable and to another control circuit.

In the alternative arrangement of the above-described control circuit 200 shown in FIG. 13, the electrical power sockets 20*a*, 20*b* of the connector 10 are always electrically connected to the active power supply and are always live. The control circuit 200 is used to control the operation of a series of electric devices, such as additional connectors, electrically connected to the power cable 44 after the connector 10.

In the arrangement shown, the first section 212 of the cut active wire 50 extends into, and is seated in, a left hand side of the active channel 70. An end portion of the first section 212 of the active wire 50 overlies the active IDC 76. The first section 212 of the active wire 50 can thereby be electrically connected to the active IDC 76. The second section 214 of the active wire 50 extends into, and is seated in, a right hand side of the control wire channel 72. An end portion of the second section 214 of the active wire 50 overlies the spare IDC 140. The earth and neutral wires 48, 46 are respectively arranged in the earth and neutral wire channels 68, 66.

As mentioned, the control circuit 200 includes first and second insulated conductors 216, 218 electrically connected to respective sides of a switch 220. An end section of the first insulated conductor 216 extends into a traverse wire channel 230 through an opening in the opposite side wall portion 62 and overlies the active IDC 76. The first insulated conductor 216 can thereby be electrically connected to the active IDC 76. Similarly, an end section of the second insulated conductor 218 extends into the spare wire channel 222 through an opening in the opposite side wall portion 62 and overlies the spare IDC 140. The second insulated conductor 218 can thereby be electrically connected to the spare IDC 140.

When the part 14 is closed over the part 12 in the above-described manner, the insulated conductors 46, 48, 212, 214, 216, 218 are forced into respective ones of the IDCs 74, 78, 76, 140, 76, 140 by corresponding lengthwise extending projections 98.

The first section 212 of the active wire 50 is always connected to the active IDC 76 and, as such, the active contact element 30 is always live. The electrical power sockets 20*a*, 20*b* are thereby always live.

The first section 212 and the second section 214 of the active wire 50 are electrically connected by way of the control circuit 200. The switch 220 is thereby used to open and close the active wire 50. When the switch 220 is open, there is an open circuit between the first and second sections 212, 214 of the active wire 50 and other connectors electrically connected to the power supply cable 44 after from the connector 10 will be inactive. When the switch 220 is closed, there is a closed circuit between the first and second sections 212, 214 of the active cable 50, and the additional connectors, or any other electric device, also electrically connected to the power supply cable 44 will be active.

For example, if a number of new connectors 10 were fitted in series to the one length of power cable 44 to power a row of fluorescent lights, then the control circuit fitted to the first connector 10 in the series could be used to control the operation of the lights connected to the other connectors in the series. The lights connected to the first connector in the series would always be on.

3. Control the electrical power sockets 20*a*, 20*b* of the connector 10 without interrupting power supply for electric devices also electrically connected to the cable 44.

Figure 14:
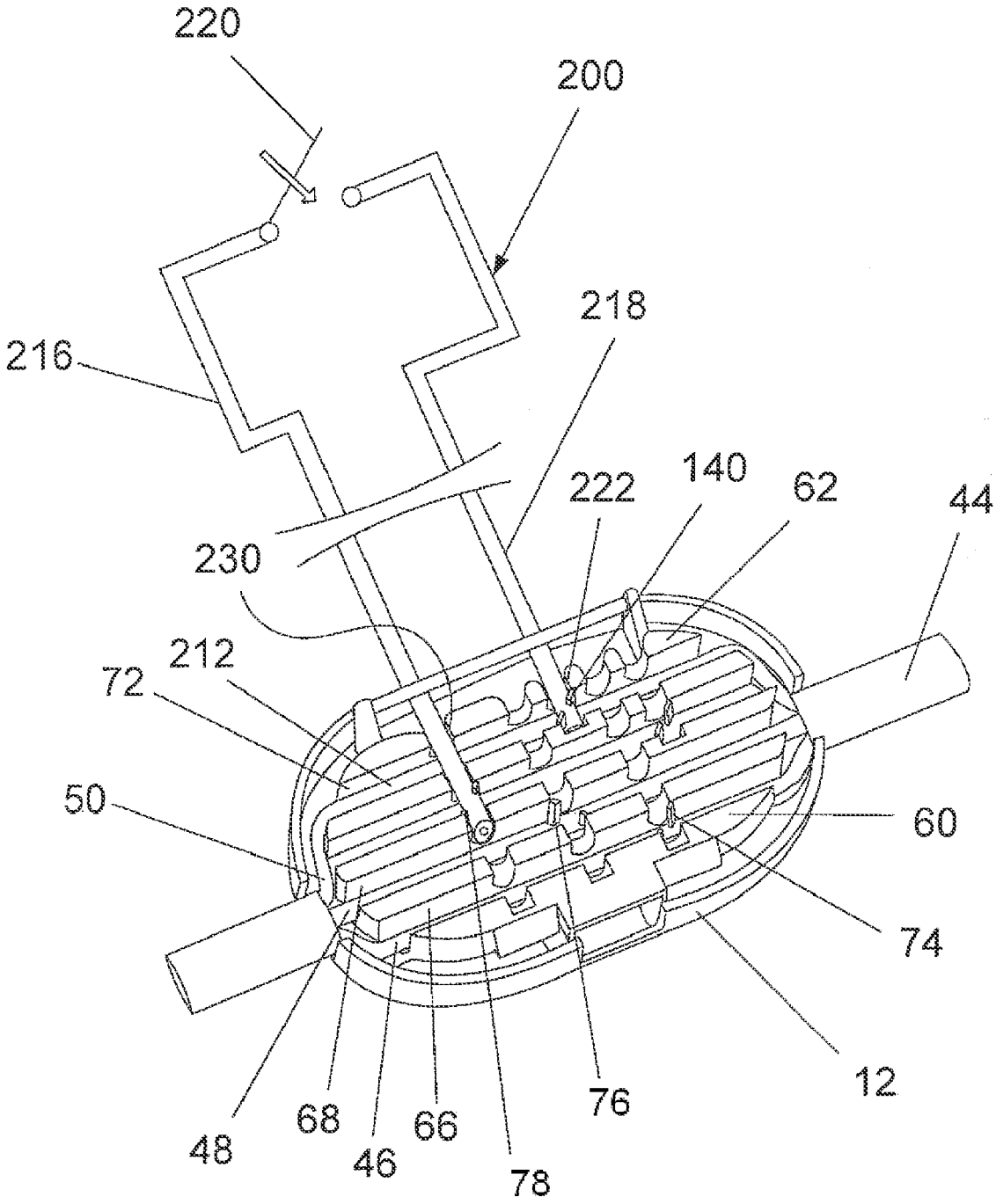
FIG. 14 is a perspective view of the part shown in FIG. 11 electrically connected to a power cable and to yet another control circuit.

In the arrangement of the above-described control circuit 200 shown in FIG. 14, the electrical power sockets 20*a*, 20*b* of the connector 10 are selectively electrically connected to the active power supply of the cable 44 by the switch 220. Operation of the control circuit 200 does not effect the operation of other electric devices also electrically connected to the power cable 44.

In the arrangement shown, the active wire 50 of the cable 44 extends into, and is seated in, the control channel 72 so as to overlie the spare IDC 140. The active wire can thereby be electrically connected to the spare IDC 140. The earth and neutral wires 48, 46 are respectively arranged in the earth and neutral wire channels 68, 66.

An end section of the first insulated conductor 216 of the control circuit 200 extends into the traverse wire channel 230, through an opening in the opposite side wall portion 62, and overlies the active IDC 76. The first insulated conductor 216 of the control circuit 200 can thereby be electrically connected to the active IDC 76. Similarly, an end section of the second insulated conductor 218 extends into the spare traverse wire channel 222 so as to overlie the spare IDC 140. The second insulated conductor 218 can thereby be electrically connected to the spare IDC 140.

When the part 14 is closed over the part 12 in the above-described manner, the insulated conductors 46, 48, 50, 216, 218 are forced into respective ones of the IDCs 74, 78, 140, 76, 140 by corresponding lengthwise extending projections 98.

In this arrangement, the active wire 50 is unbroken and passes through the connector 10. The control circuit 200 is selectively used to electrically connect the active IDC 76 to the active wire 50. In doing so, the control circuit 200 is able to control the operation of the electrical power sockets 20*a*, 20*b* without cutting off electricity in the cable 44.

For example, if a number of new connectors 10 were fitted in series to the one length of power cable 44 to power a row of fluorescent lights, then the lights could be turned on or off using individual control circuits 200, without interrupting the power on the main cable 44.

The switch 220 of the control circuit 200 is preferably located remotely from the connector 10. Alternatively, the switch 220 is located proximal to the connector 10. For example, the switch 220 is mounted on the planar surface 22 of the part 14.

The described arrangement has been advanced merely by way of explanation any many modifications may be made thereto without departing from the spirit and scope of the invention which includes every novel feature and combination of novel features herein disclosed.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

The reference to any prior art in this specification is not, and should not be taken as, an acknowledgment or any form of suggestion that that prior art forms part of the common general knowledge in Australia.

PARTS

10 Connector
12 Part
14 Part
16 Wire channel plate
20*a*, 20*b* Electrical power socket
22 Planar surface
24, 26, 28 Apertures
30 Active contact element
32 Neutral contact element
34 Earth contact element
36*a*, 36*b* End portions
38*a*, 38*b* End portions
40*a*, 40*b* End portions
42 Cable channel
44 Cable
46 Neutral wire
48 Earth wire
50 Active wire
52 Outer cover of cable
54 First wall
56 Second wall
58 Third wall
60 Side wall portion
62 Opposite side wall portion
66 Neutral wire channel
68 Earth wire channel
70 Active wire channel
72 Control wire channel
74, 76, 78, 80 Insulation displacement contacts
82*a*, 82*b* Upstanding contact portion
84 Upwardly open space
86 Elongate planar roof portion
88 Rim portion
90 Hinge 90
92 Lugs
94 Hinge pin
96 Part-tubular elongate portion
98 Lengthwise extending projections
98*a*, 98*b*, 98*c* Lengthwise projection

100 End portions of the outer covering of the cable
102 Resilient clips
108*a*, 108*b* Restraining flanges
110*a*, 110*b* Lugs
120 Second cable
122 Transverse active wire channel
124 Transverse earth wire channel
126 Transverse neutral wire channel
128 Transverse active insulated wire
130 Transverse earth insulated wire
132 Transverse neutral insulated wire
140 Insulation displacement contact
198 Slot
200 Control circuit
212 First section of active wire
214 Second section of active wire
216 First insulated conductor of control circuit
218 Second insulated conductor of control circuit
220 Switch
222 Spare transverse channel
224 Another transverse wire channel
230 Another transverse wire channel

The invention claimed is:

1. An electrical connector for making electrical connection to insulated conductors, the connector having:

(a) a first connector part defining:

(i) control, active and ground lengthwise extending wire channels for receiving lateral sections of insulated conductors of a first cable extending through the connector; and (ii) control, active, and ground transverse wire channels respectively intersecting with the control, active and ground lengthwise extending wire channels;

(b) a second connector part coupled to the first connector part so as to move between open and closed positions;

(c) a plurality of insulation displacement contacts (IDC's) including:

(i) a control IDC positioned at an intersection of the control lengthwise extending wire channel and the control transverse wire channel;

(ii) an active IDC positioned at an intersection of the active lengthwise extending wire channel and the active transverse wire channel; and (iii) a ground IDC positioned at an intersection of the ground lengthwise extending wire channel and the ground transverse wire channel, wherein the insulated conductors seated in intersecting channels are electrically coupled to respective one of said IDCs when the first connector part and the second connector part are moved to the closed position; and (d) an electrical power socket defined on the first connector part, the electrical power socket being configured to receive an electrical plug, the electrical power socket including electrically conductive contact elements that are electrically connected to respective active and ground IDCs;

wherein the active and ground transverse wire channels are adapted to receive end sections of insulated conductors of a second power cable and electrically connect them with insulated conductors of the first power cable extending through the active and ground lengthwise extending wire channels when the first and second connector parts are closed; and wherein the control and active transverse wire channels are adapted to receive insulated conductors of a control circuit to control operation of the power socket and/or operation of electric devices electrically connected to the first power cable downstream of the connector.

2. A connector as claimed in claim 1, wherein said insulation displacement contacts form parts of contact elements which form socket contacts of two sockets formed on the first part, said sockets being adapted to receive and make electrical connection to electrical plugs.

3. A connector as claimed in claim 1, wherein the transverse channels intersect the lengthwise extending wire channels at an angle of substantially 90 degrees.

4. A connector as claimed in claim 3, wherein slots of the insulation displacement contacts are oriented substantially 45° to a direction of extent of the transverse wire channels.

5. A connector as claimed in claim 1, further comprising means for controlling the operation of the socket.

6. A connector as claimed in claim 1, further comprising restraining means for restraining said relative movement between the first and second connector parts such that said connections between the insulation displacement contacts and the conductors are made substantially sequentially.

7. A connector as claimed in claim 6, wherein the lengthwise extending wire channels are side-by-side, and generally in a common plane, and the restraining means is arranged to, in use, restrain the parts for relative swinging movement about an axis which is displaced to one side of the wire channels.

8. A connector as claimed in claim 6, wherein the restraining means comprises a hinge.

9. A connector as claimed in claim 8, wherein the hinge has cooperating hinge components on the first and second parts, for constraining the parts for relative swinging movement with respect to each other.

10. A connector as claimed in claim 1, wherein the insulation displacement contacts are carried by said first part.

11. A connector as claimed in claim 1, wherein the insulation displacement contacts are carried by said second part.

12. A connector as claimed in claim 1, wherein said second part has projections for sequentially engaging insulated conductors seated in the lengthwise extending wire channels during said relative movement.

13. A connector as claimed in claim 1, wherein the connector is adapted to interface with the control circuit to control operation of the socket.

14. A connector claimed in claim 1, wherein the first connector part also defines a second active transverse wire channel which intersects with another section of the active lengthwise extending wire channel, the second active transverse wire channel including a second active IDC positioned at an intersection of the active lengthwise extending wire channel and the second active transverse wire channel, wherein the connector is also adapted to electrically connect end sections of insulated conductors of a control circuit seated in the control transverse wire channel and the second active transverse wire channel to the control IDC and the second IDC to thereby control operation of the power socket and/or operation of electric devices electrically connected to the first power cable down stream of the connector.

15. A connector as claimed in claim 1, further comprising:

an active insulated conductor of a first power cable extending through the connector via the control channel and electrically connected to the control IDC;

a control circuit for remotely controlling operation of the power socket without affecting operation of additional electric devices electrically connected to the first power cable downstream of the electric connector, including:

(a) a first insulated conductor including an end section seated in the active transverse wire channel and electrically coupled to the active IDC;

(b) a second insulated conductor including an end section seated in the control transverse wire channel and electrically coupled to the control IDC; and (c) a switch located remotely from a main body portion of the connector, the switch being electrically coupled between the first and second insulated conductors for selectively electrically connecting the active IDC to the control IDC so as to electrically connect the active IDC to the active insulated conductor of the first power cable extending through the connector via the control channel.

16. A connector claimed as claimed in claim 1, further comprising:

an active insulated conductors of a first power cable including a first section of the extending into the connector through the active lengthwise wire channel to the active IDC and a second section of the active insulated conductor extending from the connector via the control IDC through the control lengthwise extending wire channel;

a control circuit for remotely controlling operation of one or more electric devices also electrically connected to the first power cable downstream of the connector without affecting operation of the electrical power socket including:

(a) a first insulated conductor including an end section seated in the active transverse wire channel and electrically coupled to the active IDC;

(b) a second insulated conductor including an end section seated in the control transverse wire channel and electrically coupled to the control IDC; and (c) a switch located remotely from a main body portion of the connector, the switch being electrically coupled between the first and second insulated conductors for selectively electrically connecting the active IDC to the control IDC so that the first section of the active insulated conductor can be selectively electrically connected to the second section of the active insulated conductor.

17. An electrical connector, comprising:

(a) a first connector part defining:

(i) control, active, and ground lengthwise extending wire channels for receiving lateral sections of insulated conductors of a first cable extending through the connector; and (ii) control and active transverse wire channels respectively intersecting with the control and active lengthwise extending wire channels;

(b) a second connector part coupled to the first connector part so as to move between open and closed positions;

(c) a plurality of insulation displacement contacts (IDCs) including:

(i) a control IDC positioned at an intersection of the control lengthwise extending wire channel and the control transverse wire channel;

(ii) an active IDC positioned at an intersection of the active lengthwise extending wire channel and the active transverse wire channel;

(iii) a ground IDC positioned in the ground lengthwise extending wire channel, wherein the insulated conductors are coupled to respective IDCs when the first connector part and the second connector part are moved to the closed position;

(d) an electrical power socket defined on the first connector part, the electrical power socket being configured to receive an electrical plug, the electrical power socket including electrically conductive contact elements that are respectively electrically connected to the active IDC and the ground IDC; and (e) a control circuit for remotely controlling operation of the power socket without affecting operation of additional electric devices electrically connected to the first power cable downstream of the electric connector, including:

(i) a first insulated conductor including an end section seated in the active transverse wire channel and electrically coupled to the active IDC;

(ii) a second insulated conductor including an end section seated in the control transverse wire channel and electrically coupled to the control IDC; and (iii) a switch located remotely from a main body portion of the connector, the switch being electrically coupled between the first and second insulated conductors for selectively electrically connecting the active IDC to the control IDC so as to electrically connect the active IDC to an active insulated conductor of the first power cable extending through the connector via the control channel.

18. An electrical connector, comprising:

(a) first connector part defining:

(i) control, active and ground lengthwise extending wire channels for receiving lateral sections of insulated conductors of a first cable extending through the connector; and (ii) control and active transverse wire channels respectively intersecting with the control and active lengthwise extending wire channels;

(b) a second connector part coupled to the first connector part so as to move between open and closed positions;

(c) a plurality of insulation displacement contacts (IDCs) including:

(i) a control IDC positioned at an intersection of the control lengthwise extending wire channel and the control transverse wire channel;

(ii) an active IDC positioned at an intersection of the active lengthwise extending wire channel and the active transverse wire channel; and (iii) a ground IDC positioned in the ground lengthwise extending wire channel, wherein the insulated conductors are coupled to respective IDCs when the first connector part and the second connector part are moved to the closed position;

(d) an electrical power socket defined on the first connector part, the electrical power socket being configured to receive an electrical plug, the electrical power socket including electrically conductive contact elements that are respectively electrically connected to the active IDC and the ground IDC; and (e) a control circuit for remotely controlling operation of one or more electric devices separately electrically connected to the first power cable downstream of the connector without affecting operation of the electrical power socket including:

(i) a first insulated conductor including an end section seated in the active transverse wire channel and electrically coupled to the active IDC;

(ii) a second insulated conductor including an end section seated in the control transverse wire channel and electrically coupled to the control IDC; and (iii) a switch located remotely from a main body portion of the connector, the switch being electrically coupled between the first and second insulated conductors for selectively electrically connecting the active IDC to the control IDC so that a first section of an active insulated conductor extending into the connector through the active lengthwise wire channel to the active IDC can be selectively electrically connected to a second section of the active insulated conductor extending from the connector via the control IDC through the control lengthwise extending wire channel.

* * * * *